US006922476B2

(12) United States Patent
Nassimi

(10) Patent No.: US 6,922,476 B2
(45) Date of Patent: Jul. 26, 2005

(54) ADJUSTABLE EAR CANAL RETENTION TRANSCEIVER/RECEIVER

(76) Inventor: Shary Nassimi, 2002 NW. 215 Cir., Ridgefield, WA (US) 98642

( * ) Notice: Subject to any disclaimer, the term of this patent is extended or adjusted under 35 U.S.C. 154(b) by 0 days.

(21) Appl. No.: 10/261,367

(22) Filed: Sep. 30, 2002

(65) Prior Publication Data

US 2004/0062412 A1 Apr. 1, 2004

(51) Int. Cl.[7] ..... H04R 25/00
(52) U.S. Cl. ..... 381/380; 381/392
(58) Field of Search ..... 381/392, 395, 381/189, 380, 322, 325, 328, 382, 390; 379/430, 431; 455/569.1, 575.1, 575.2, 575.5, 575.8

(56) References Cited

U.S. PATENT DOCUMENTS 6,230,029 B1 * 5/2001 Hahn et al. ..... 455/575.2
6,671,381 B1 * 12/2003 Lux-Wellenhof ..... 381/325
2002/0131585 A1 * 9/2002 Jones et al. ..... 379/431
2003/0211871 A1 * 11/2003 Nassimi ..... 455/575.1
2004/0010181 A1 * 1/2004 Feeley et al. ..... 600/25
2004/0028218 A1 * 2/2004 Rath et al. ..... 379/430

* cited by examiner

*Primary Examiner*—Curtis Kuntz
*Assistant Examiner*—Brian Ensey
(74) *Attorney, Agent, or Firm*—George R. McGuire; Bond, Schoeneck & King, PLLC

(57) ABSTRACT

The present invention teaches a retainer in the form of a removable compliant polymer sheath. The present invention further teaches a wireless headset reduced in size to an earpiece, in which the comfort and sanitation of the user and the life span of the device may in increased by providing a replaceable compliant polymer sheath for the sound tube which is inserted into the ear canal: friction between the ear canal and the sheath retains the wireless headset in the ear canal. In alternative embodiments, the sheath and ear canal may mechanically cooperate to retain the wireless headset in the ear canal. The sheath may be easily removed and replaced so as to adapt the length and diameter of the device for the needs and comfort of different users. In addition, the replaceable polymer sheath allows safe and sanitary use of one wireless device by more than one user. In addition, polymers are notorious for becoming oxidized and then hard and brittle, however the device of the invention need not be refurbished for this reason since the compliant polymer sheath may be easily removed and replaced whenever required.

11 Claims, 7 Drawing Sheets

ADJUSTABLE EAR CANAL RETENTION TRANSCEIVER/RECEIVER

FIELD OF THE INVENTION

This invention relates generally to wireless headsets and more specifically to a transceiver/receiver headset with an adjustable in-ear friction retainer sheath.

BACKGROUND OF THE INVENTION

Wireless headsets provide greater convenience and safety to the users of such devices as cell phones, by allowing the user partially or completely hands free operation of the cell phone. Such headsets normally comprise some sort of head band or ear clip to retain the headset in the proper position, a microphone located near the mouth, and such wireless equipment as is necessary to communicate with a base unit located at or on the cell phone or similar device.

However, the comfort and convenience of the wireless headset may be reduced by the method of maintaining the headset in position on the user's head. Head bands which cross over the top of the head quickly become uncomfortable and may slip out of position. Ear clips also suffer from the problem of discomfort. Various types of headsets exist which illustrate these difficulties.

U.S. Pat. No. 4,882,745 issued Nov. 21, 1989 to Silver for "CORDLESS HEADSET TELEPHONE" shows one early telephone headset in the context of a conventional land-line telephone. The headset disclosed has a large ear piece, telescoping antennas in both base unit and headset, and a cross section so large as to include a keypad on the headset portion of the device. The headset also includes on/off switches and a manual volume control. The size of this headset is notable.

U.S. Pat. No. 5,590,417 issued Dec. 31, 1996 to Rydbeck for "RADIOTELEPHONE APPARATUS INCLUDING A WIRELESS HEADSET" teaches a headset in which recharging is accomplished when the headset is attached to the base transceiver unit. Two embodiments are taught in both of which manual control of headset output volume is accomplished manually at the base transceiver unit. The wired version of the unit is small but the wireless version appears to be almost as large as the original cell phone, somewhat defeating the intent of the device.

U.S. Pat. No. 5,790,684 issued Aug. 4, 1988 to Niino et al for "TRANSMITTER/RECEIVING APPARATUS FOR USE IN TELECOMMUNICATIONS" teaches a multiplicity of earphones (connected by wire 17 and similar wires) which are wired to a cell phone. It is small, wired, and does not appear to provide any means of adapting to the ear sizes of different users or assuring comfortable and sanitary operation.

U.S. Pat. No. 5,933,506 issued Aug. 3, 1999 to Aoki et al for "TRANSMITTER-RECEIVER HAVING EARPIECE TYPE ACOUSTIC TRANSDUCING PART" teaches a non-wireless headset with an earpiece connected thereto. It is small, wired, and does not appear to provide any means of adapting to the ear sizes of different users or assuring comfortable and sanitary operation.

U.S. Pat. No. 6,078,825 issued Jun. 20, 2000 to Hahn et al. for "MODULAR WIRELESS HEADSET SYSTEM FOR HANDS FREE TALKING" and U.S. Pat. No. 6,230,029 B1 issued May 8, 2001 to Hahn et al. for "MODULAR WIRELESS HEADSET SYSTEM" disclose a headset having battery contacts used to charge the removable battery pack module. These patents also teach that the headset have manual on/off, channel and volume controls. The unit is nicely streamlined but uses a bulky earclip and a long microphone tube which together probably render it somewhat heavy and uncomfortable.

U.S. Pat. No. 6,228,020 issued May 8, 2001 to Juneau et al for "COMPLIANT HEARING AID" comes from the technical field of hearing aid design, not wireless headset design. It teaches a hearing aid having a soft polymeric body covering the part inserted into the ear. This provides comfort and convenience to the sole owner, however, sharing of hearing aids is extremely uncommon, and thus no provision is made for adjusting the size of the unit to different users, nor for sanitation, nor for replacement of the body when it is worn out.

U.S. Pat. No. 6,415,034 issued Jul. 2, 2002 to Hietanen for "EARPHONE UNIT AND A TERMINAL DEVICE" discloses a small unit which is mounted in the external ear (for the wireless version of FIG. 12) by means of a lug in the ear canal. It does not appear to provide any means of adapting to the ear sizes of different users or assuring comfortable and sanitary operation.

Finally, US Patent Application Publication No. U.S. 2001/0016506 A1 published Aug. 23, 2001 in the name of Son et al. and entitled "WIRELESS HANDS-FREE SYSTEM OF CELLULAR PHONE" teaches a battery operated hands free headset having a battery saving feature described in paragraph 0014. No indication of any means of charging of the battery is present in the publication, and as specified in the final phrase of paragraph 0013, a switch on the headset is operated by the user. The device is smaller than most of the prior art devices but still appears to be larger than the user's ear, to which it is clipped by means of a clip 303.

SUMMARY OF THE INVENTION

General Summary

While previous wireless headsets teach a retainer for the device that may be a headband or ear clip, the present invention teaches a retainer in the form of a removable compliant polymer sheath.

The present invention teaches a wireless headset reduced in size to an earpiece, in which the comfort and sanitation of the user and the life span of the device may in increased by providing a replaceable compliant polymer sheath for the sound tube which is inserted into the ear canal: friction between the ear canal and the sheath retains the wireless headset in the ear canal. In alternative embodiments, the sheath and ear canal may mechanically cooperate to retain the wireless headset in the ear canal. The sheath may be easily removed and replaced so as to adapt the length and diameter of the device for the needs and comfort of different users. In addition, the replaceable polymer sheath allows safe and sanitary use of one wireless device by more than one user. In addition, polymers are notorious for becoming oxidized and then hard and brittle, however the device of the invention need not be refurbished for this reason since the compliant polymer sheath may be easily removed and replaced whenever required.

Summary in Reference to Claims

It is therefore one aspect, advantage, objective and embodiment of the present invention to provide a retainer for wireless headsets having a generally cylindrical sound tube for insertion into a user's ear canal, the sound tube having a generally cylindrical configuration; the retainer comprising: a generally cylindrical sheath having an exterior sheath configuration and an interior sheath configuration; the interior sheath configuration being approximately the same as such sound tube configuration, whereby such sheath may be easily disposed onto and removed from such sound tube; the exterior sheath configuration being dimensioned and configured for comfortable use and suspension of the wireless headset by means of forces between such ear canal and the sheath; the sheath further having at least one aperture allowing sound transmission between such sound tube and such ear canal.

It is therefore one more aspect, advantage, objective and embodiment of the present invention to provide a retainer wherein the sheath is a compliant polymer material.

It is therefore one more aspect, advantage, objective and embodiment of the present invention to provide a retainer wherein the sheath is one member of the group consisting of: silicon based materials, silicon compounds, elastomeric materials, flexible materials, rubbers, gums, gels, soft silicon-like materials, liquids, liquids encased in a compliant shell, and combinations thereof.

It is therefore one more aspect, advantage, objective and embodiment of the present invention to provide a retainer wherein the sheath is one member of the group consisting of: mixtures of multiple compounds, mixtures of multiple polymers, polyphase foams, open cell foams, closed cell foams, material intrusions, material cells, liquids, and combinations thereof.

It is therefore one more aspect, advantage, objective and embodiment of the present invention to provide a retainer further comprising: an open end; and a circumferential ridge of material about the open end.

It is therefore one more aspect, advantage, objective and embodiment of the present invention to provide a retainer wherein the forces between the sheath and such ear canal are frictional forces.

It is therefore one more aspect, advantage, objective and embodiment of the present invention to provide a retainer wherein the interior sheath configuration is dimensioned and configured such that the sheath is retained upon the sound tube by means of forces between the sheath and the sound tube.

It is therefore one more aspect, advantage, objective and embodiment of the present invention to provide a retainer wherein the forces between the sheath and the sound tube are frictional forces.

It is therefore one more aspect, advantage, objective and embodiment of the present invention to provide a retainer wherein the sheath and the sound tube mechanically cooperate to retain the sheath upon the sound tube.

It is therefore one more aspect, advantage, objective and embodiment of the present invention to provide a retainer wherein the headset body further comprises: a circumferential groove about the sound tube, and wherein the circumferential ridge of material about the open end of the sheath mechanically cooperates with the groove to retain the sheath upon the sound tube.

It is therefore one more aspect, advantage, objective and embodiment of the present invention to provide an improved wireless headset having a headset body wherein the improvement comprises: a sound tube; a removable sheath disposed on the sound tube, the sheath having at least one aperture therethrough, the sheath begin dimensioned and configured such that when the sound tube is inserted into the ear canal of a user, the wireless headset is retained on the user's head by the forces between the sound tube and the ear canal.

It is therefore one more aspect, advantage, objective and embodiment of the present invention to provide an improved wireless headset further comprising: at least one aperture in the sound tube, the aperture in the sheath being aligned with the aperture in the sound tube; and a mini-speaker arranged so as to pass sound from the mini-speaker out of the headset body through the aperture in the sound tube and the aperture in the sheath.

It is therefore one more aspect, advantage, objective and embodiment of the present invention to provide an improved wireless headset further comprising: a removable and replaceable antenna casing.

It is therefore one more aspect, advantage, objective and embodiment of the present invention to provide an improved wireless headset further comprising one member selected from the group consisting of: a transceiver, a microphone, a receiver, an antenna, a battery and combinations thereof.

It is therefore one more aspect, advantage, objective and embodiment of the present invention to provide an improved wireless headset wherein the antenna further comprises an antenna casing incorporating a microphone tube extending towards the mouth of the user.

It is therefore one more aspect, advantage, objective and embodiment of the present invention to provide a wireless headset comprising: a headset body; a sound tube projecting from the headset body and having an aperture; a mini-speaker disposed within the headset body so as to pass sound from the mini-speaker out of the headset body through the aperture; a removable sheath disposed on the sound tube.

It is therefore one more aspect, advantage, objective and embodiment of the present invention to provide a wireless headset wherein the removable sheath further comprises one member selected from the group consisting of: a compliant polymer material, silicon based materials, silicon compounds, elastomeric materials, flexible materials, rubbers, gums, gels, soft silicon-like materials, liquids, liquids encased in a compliant shell, and combinations thereof.

It is therefore one more aspect, advantage, objective and embodiment of the present invention to provide a wireless headset further comprising one member selected from the group consisting of: a microphone, a transceiver, a receiver, an antenna, a battery and combinations thereof.

It is therefore one more aspect, advantage, objective and embodiment of the present invention to provide a wireless headset further comprising: a battery; and a battery cap having knurls allowing easier removal and replacement of the battery cap, thereby allowing easier removal and replacement of the battery.

It is therefore one more aspect, advantage, objective and embodiment of the present invention to provide a wireless headset further comprising: an antenna casing having an antenna therein.

DETAILED DESCRIPTION

Figure 1:
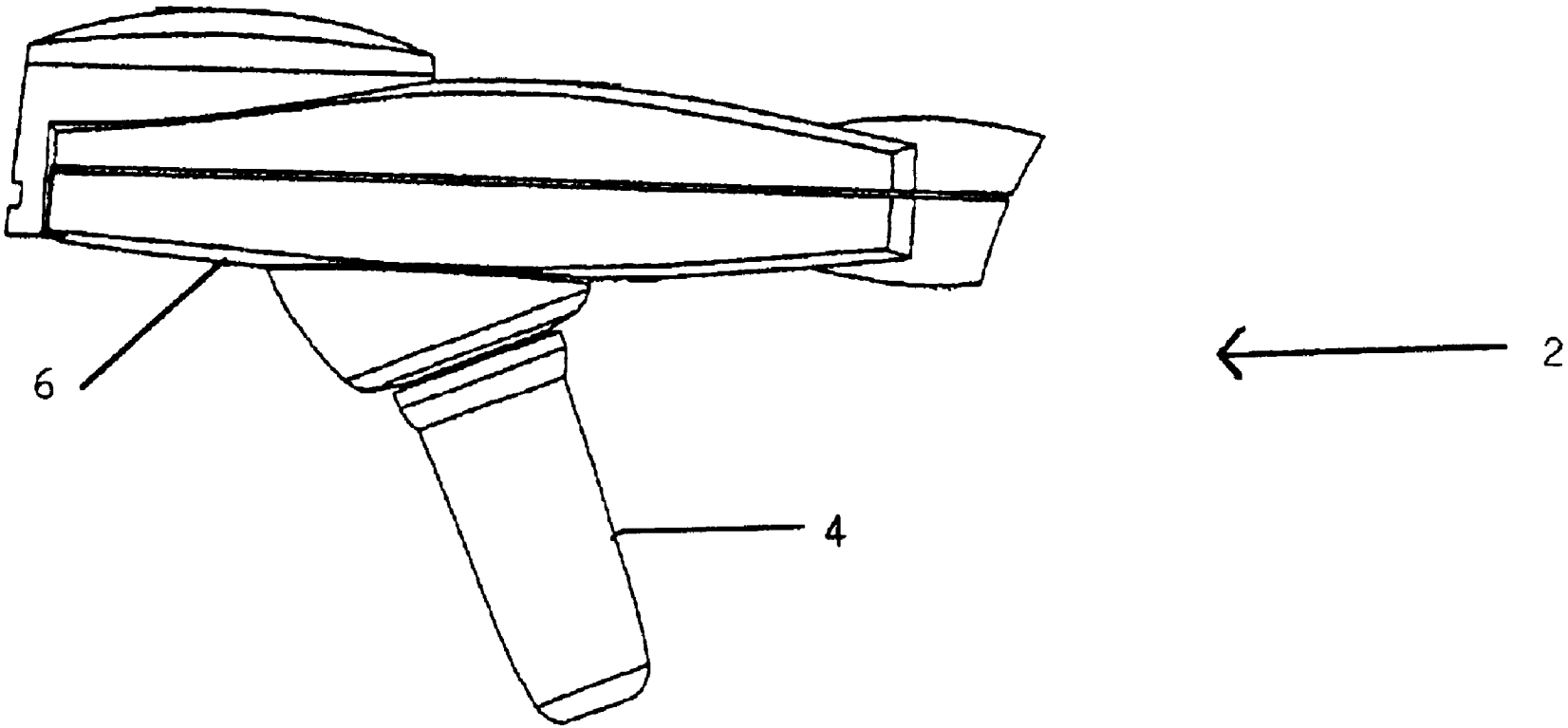
FIG. 1 is a side view of a wireless headset embodying the sheath of the preferred embodiment of the invention.
Figure 2:
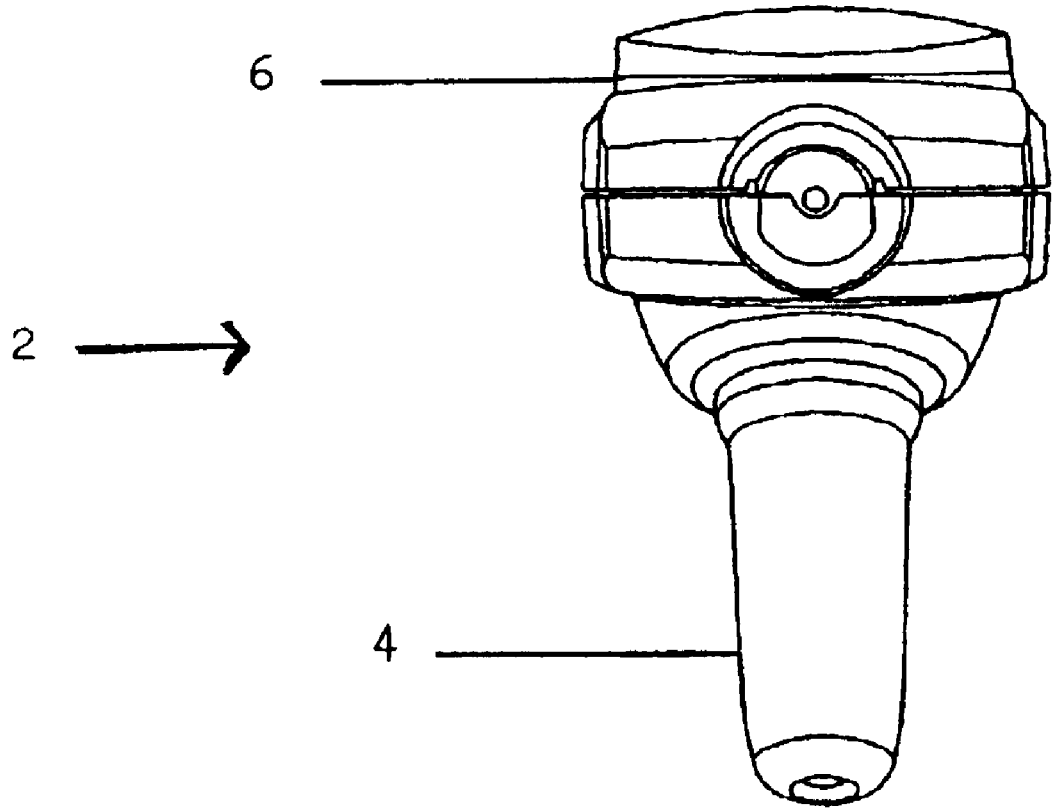
FIG. 2 is an end view of the wireless headset of the first embodiment shown in FIG. 1.
Figure 3:
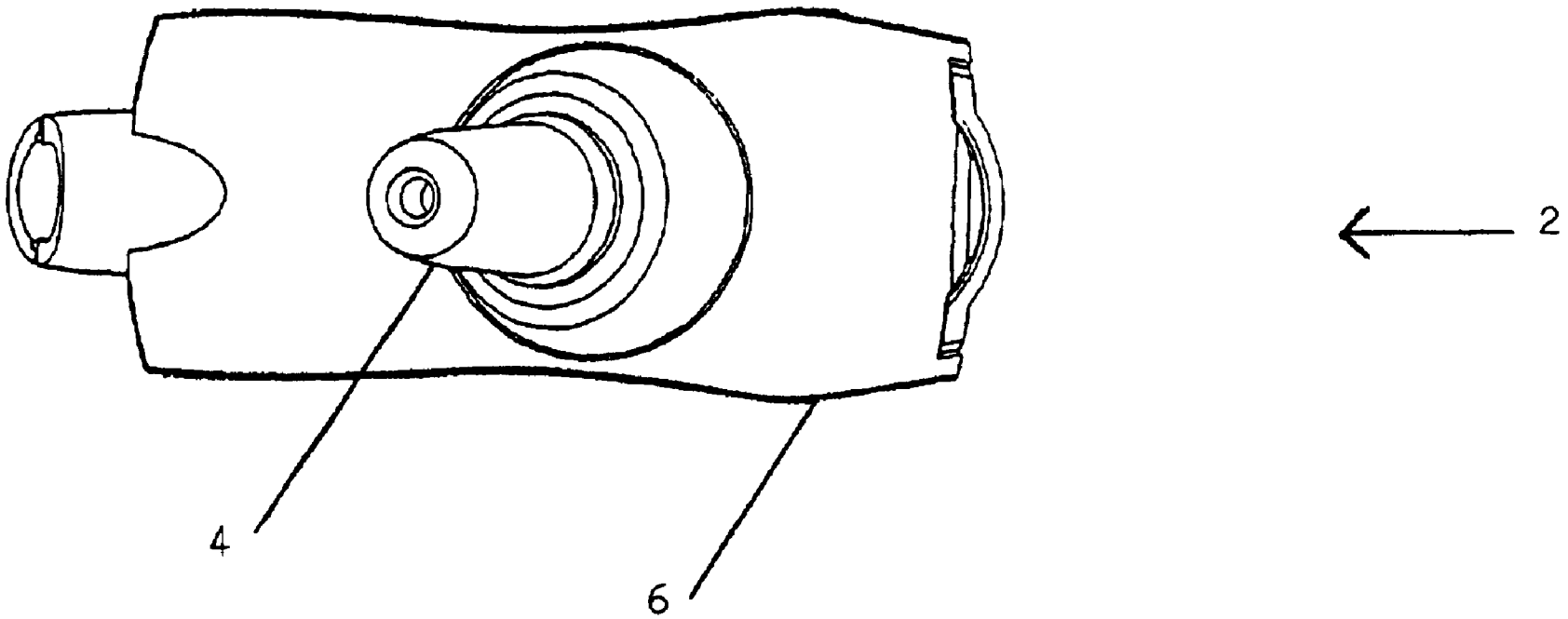
FIG. 3 is a bottom view of the wireless headset of the first embodiment shown in FIG. 1.

FIG. 1 is a side view of a wireless headset embodying the sheath of the preferred embodiment of the invention. FIG. 2 is an end view of the wireless headset of the first embodiment shown in FIG. 1. FIG. 3 is a bottom view of the wireless headset of the first embodiment shown in FIG. 1. As seen in these three figures, headset 2 has sheath 4 which fits into the ear canal (not pictured) of a user. The ear canal is any and all of that small cavity leading from the outer ear to the inner ear. Friction between the interior of sheath 4 and the headset body 6 retains sheath 4 in place on wireless headset 2, friction between the exterior of sheath 4 and the ear canal retains headset body 6 of wireless headset 2 in place. As used herein, a sheath is any removable covering used to cover a projection into the ear canal, regardless of the shapes of the ear canal or projection. While sheath 4 is a compliant polymer material, headset body 6 may be a relatively more rigid construction such as plastic, metal or another more rigid polymer. In general, any such projection into the ear canal will be referred to herein as a sound tube: the sound tube configuration may vary a good deal in size, shape, form and substance: it may be entirely rigid, semi-rigid, it may be cylindrical, generally cylindrical, irregular, fitted to the ear or another shape. The sound tube will usually have therein either a speaker or an aperture, grill, mesh or other device to allow sound to pass from a mini-speaker in the sound tube or wireless headset body 6 to the ear canal of the user, and/or pass the other direction. The aperture in the sound tube is aligned with the aperture in the sheath when the sheath is disposed upon the sound tube.

Figure 4:
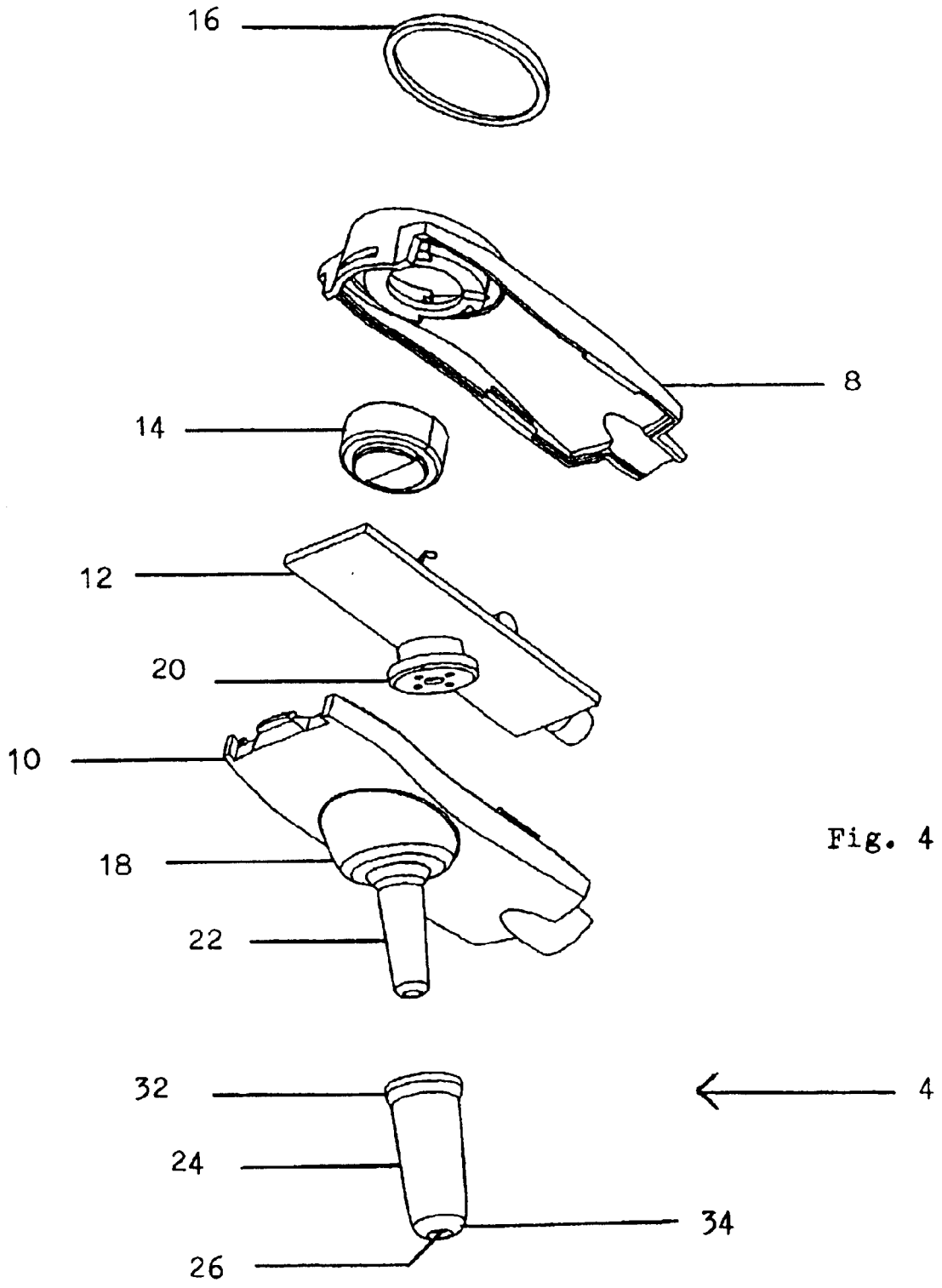
FIG. 4 is an exploded perspective view of the wireless headset of the first embodiment shown in FIG. 1.

FIG. 4 is an exploded perspective view of the wireless headset of the first embodiment shown in FIG. 1. In the best mode now contemplated and presently preferred embodiment of the invention, by means of sheath 4 of the present invention, the wireless headset may miniaturized greatly as no headband or ear clip retainers are necessary. Sheath 4 will suffice to comfortably hold in place the super miniaturized headset for long periods of time, unlike large headsets having such forms of retainers. Unlike prior art ear pieces which rely on friction directly between the sound tube and the ear canal, sheath 4 of the wireless headset of the present invention maintains an adequate comfort level. Unlike any known combination of patents taken from related and unrelated technologies, the invention has a removable and replaceable sheath over a permanent, more rigid body (in this case, the sound tube).

The wireless headset of the preferred embodiment of the invention has an upper body 8, a lower body 10, and circuitry 12 disposed in between. In the preferred embodiment, circuitry 12 comprises a printed circuit board with silicon electronic components thereon. Battery 14 provides electrical power, battery 14 may be changed by removing cap 16 (note that while battery 14 is below upper body 8 in FIG. 4, it may be above or co-elevation therewith, even in the preferred embodiment pictured).

The wireless headset may include either a receiver or a transceiver allowing both reception and transmission. In receiver embodiments, it may be utilized to carry an audio signal in a passive mode, for example a broadcast radio signal or a signal received from a broadcast unit which itself receives the audio signal from a source such as a television set or radio. In transceiver embodiments, the wireless headset may be used in conjunction with a cell phone or similar device to provide true hands free operation without a wire, a bulky headset having an ear clip or head band, and yet with increased comfort and sanitary benefits to the wearer.

Speaker housing 18 contains mini-speaker 20. One advantage of the method of the present invention is that mini-speaker 20 may be sized, selected and arranged so as to minimize power drain upon battery 14. That is, use of sheath 4, the wireless headset of the present invention may be maintained in very close position to the ear drum of the user, thus minimizing drive current needed for mini-speaker 20. In addition, the configuration of speaker housing 18 includes sound tube 22, which actually projects into the ear canal of the wearer, directing sound precisely at the ear drum of the user and potentially bringing mini-speaker 20 even closer to the ear drum in alternative embodiments. Thus, a smaller speaker, smaller battery and smaller unit are permitted by the invention, thus furthering the convenience of the user. Mini-speaker 20 may be a peizo-electric device, a button speaker, or another type of speaker.

Sheath 4 is generally cylindrical in the drawings and preferred embodiment, having a slightly conical exterior sheath configuration. In alternative embodiments, sheath 4 may be more sharply conical in exterior sheath configuration, may be a true cylinder, may be an ogive shape, a rounded shape, parabolic, elliptical, other regular shapes, or it may be an irregular shape or have an exterior sheath configuration specifically designed for the human ear or even for the ear of one or specific individuals. As used herein, the words exterior sheath configuration encompass any shape of the exterior of the sheath. The exterior sheath configuration is dimensioned and configured for (that is, is size, shape, form and substance are suitable for) comfortable use and suspension of the wireless headset by means of frictional forces between ear canal and sheath. Thus, placed into the ear, sheath 4 generates sufficient frictional forces to hold the tiny weight of the wireless headset in proper place.

FIG. 4 also displays the sheath of the preferred embodiment of the invention. In the preferred embodiment, sheath 4 furthermore narrows at one end to a small aperture (aperture 26 of FIG. 4). The narrowing in the preferred embodiment takes the form of bevel 34, which terminates in aperture 26. This end is proximate the ear drum of the user and is inserted into the user's ear. At the distal end, sheath 4 has an optional circumferential ridge 32 which adds strength to sheath 4, aids manipulation of sheath 4 by human fingers, and may help to maintain sheath 4 on the sound tube of wireless headset 2. The size of aperture 26 allow sound transmission between such sound tube and such ear canal. Aperture 26 may be replaced by a pattern of smaller apertures, an aperture having a screen or other members extending across it, and so on.

Sheath 4 is retained by friction on the sound tube in the presently preferred embodiment, however, in other embodiments other methods of retention are possible. Actual mechanical cooperation is a strong alternative embodiment. For example, an alternative circumferential ridge may extend inwardly towards the longitudinal axis (long axis) of sheath 4, thus presenting a small detente on the inside of sheath 4. In such alternative embodiments, the sound tube 22 may have thereon a circumferential groove into which the circumferential ridge may fit, providing mechanical cooperation to hold sheath 4 onto sound tube 22. Sheath 4 and sound tube 22 may also be equipped with snaps, belts, fasteners, bumps or other devices for holding sheath 4 onto sound tube 22.

Sheath 4 may be made of a compliant polymer or silicon based material. In addition, may equivalent materials may be employed. Any elastomeric, flexible, material may be used: in addition to polymers and silicon based materials, silicon compounds, rubbers, gums, other materials such as gels, soft silicon-like materials, liquids, liquids encased in a compliant shell, and similar materials. In the preferred embodiment, the silicon compound or polymer is a single phase and a single compound/polymer. In alternative embodiments, mixtures of compounds may be used: mixtures of two or more compounds or polymers (including copolymers, multipolymers). Such compounds and polymers need not be uniphase bodies but may be polyphase foams, either or open or closed cell foams, or may include other material intrusions or cells such as water or other liquids, other solids which enhance material properties by adding or reducing stiffness, plastic memory, ductility and so on.

The construction of sheath 4 is subject to numerous alternatives, equivalents and substitutions within the scope of the invention as claimed herein.

While frictional forces may be implicated in retaining the wireless headset in the ear of a user in the presently preferred embodiment, in other embodiments, the sheath may be configured so that actual mechanical cooperation between the ear canal and the sheath may serve the same purpose, that is, the convolutions of the ear canal may cooperate with the exterior sheath configuration.

Figure 5:
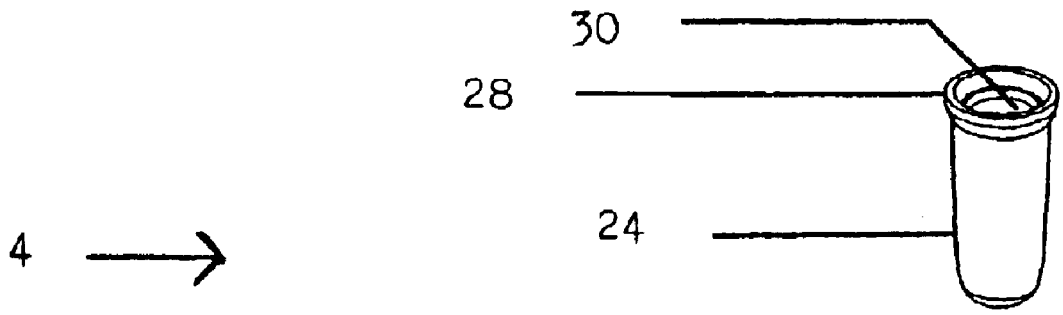
FIG. 5 is a perspective view of the sheath according to a second embodiment of the invention.

FIG. 5 is a perspective view of the sheath according to a second embodiment of the invention. Sheath 4 has sheath body 24, interior sheath configuration 30, and circumferential ridge 28 about the open end of sheath body 24. In this embodiment, circumferential ridge 28 is used to aid retention of sheath 4 on sound tube 22 by increasing frictional forces therebetween. In this embodiment, sheath 4 is provided separately from a wireless headset. Sheath 4 of this embodiment may be offered to owners of devices such as the headset which have a sound tube which is inserted into the ear canal.

Sheath 4 may be used as a retrofit to increase the comfort of devices not having such a sheath, or it may be used as a replacement when an original sheath wears out and must be replaced. Polymers, particularly relatively flexible polymers, are prone to becoming oxidized and thus replacement will increase the life span of wireless headsets and the like.

However, there are additional very significant advantages to removable and replaceable sheath 4. A device using such a sheath may be used by more than one individual without the unpleasant and unsanitary necessity of inserting the same contact surface into the ears of different individuals. A first user may use a first sheath, while a second user might use a second sheath when the device must be exchanged from ear to ear. By this means there is no chance of transmission of biological materials from ear to ear, and potential squeamishness of multiple users is averted.

Another important advantage relates to comfort. Different people have differing ear canals, meaning that a device comfortable in one person's ear canal might not be comfortably suspended in the ear canal of another. If the second user's ear canal is smaller than the size most comfortably used with a first sheath, the wireless or other device might cause pain when inserted into the ear. If the later users ear canal is larger, however, the fit will be loose; perhaps the device might fall out for this reason. Ear canals also vary in configuration, meaning that sheaths may be provided according to the second embodiment of the invention in different exterior sheath configurations. By the term configuration as used herein, the concepts of shape, size, modulus of elasticity, Young's modulus, flexibility, hardness, size of apertures and so on are all included.

Similarly, interior sheath configuration 30 may vary in order to fit the sound tube upon which it will be placed. Active tense placement of sheath 4 onto a sound tube, and passive tense location of sheath 4 on a sound tube, are both referred to herein as "disposal on the sound tube", and actively taking sheath 4 off of the sound tube, and sheath 4 being found off of a sound tube, are referred to as "removal from sound tube 4".

Figure 6:
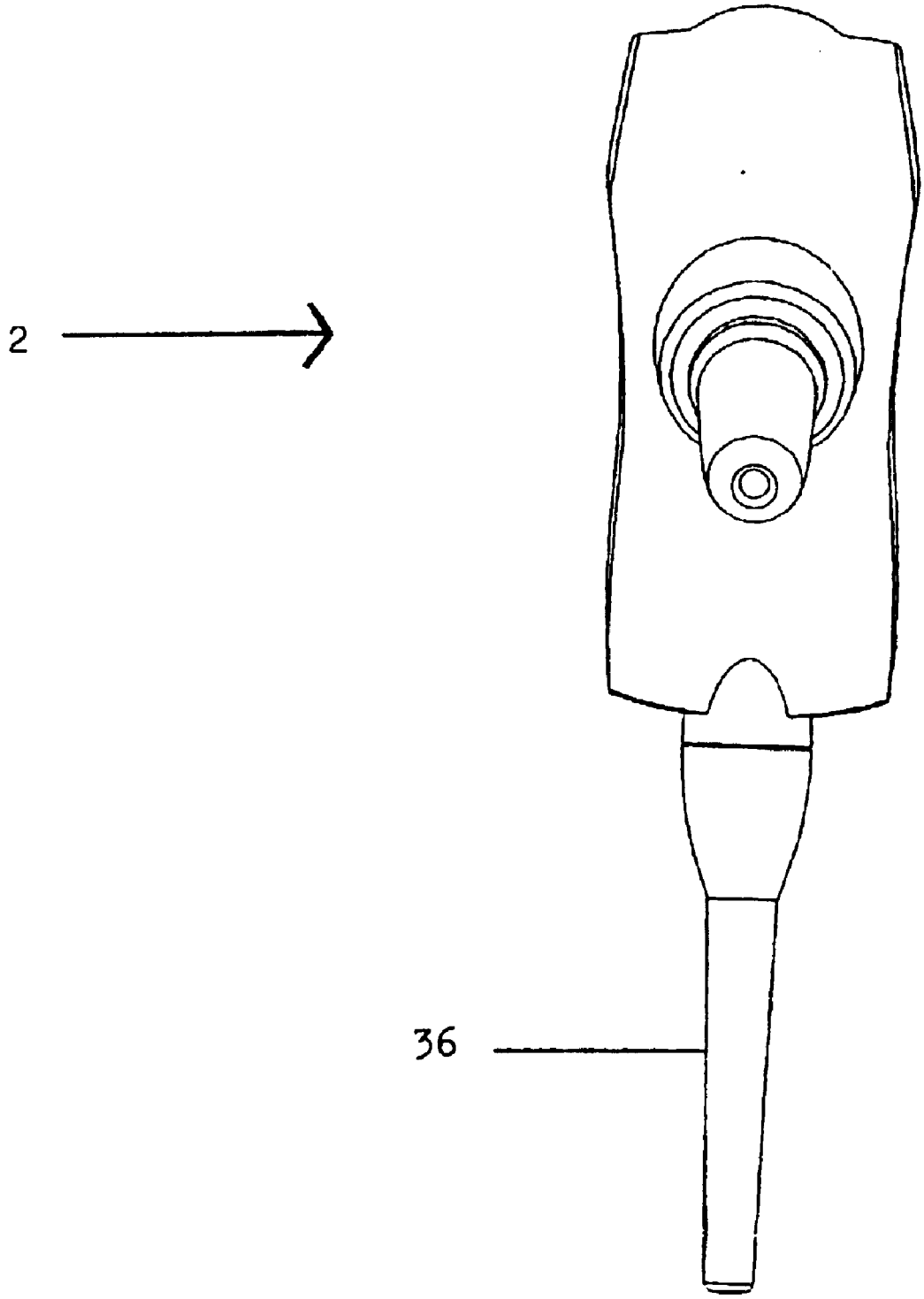
FIG. 6 a bottom view of a third embodiment of the invention.

FIG. 6 a bottom view of a third embodiment of the invention. In this embodiment, an optional antenna casing 36 is employed. By this means, radio reception of the wireless headset device, and transmission to a base station in embodiments having such, both may be dramatically improved. Antenna casing 36 may also served double duty as an optional microphone tube extending towards the mouth of the user and thus providing better audio reception of the voice of the user.

Antenna casing 36 may be a removable and replaceable device which the user may remove and replace as desired: in such alternative embodiments, the device may be used either with the antenna casing 36 on the device, or the wireless headset device may be used without the antenna casing 36.

Figure 7:
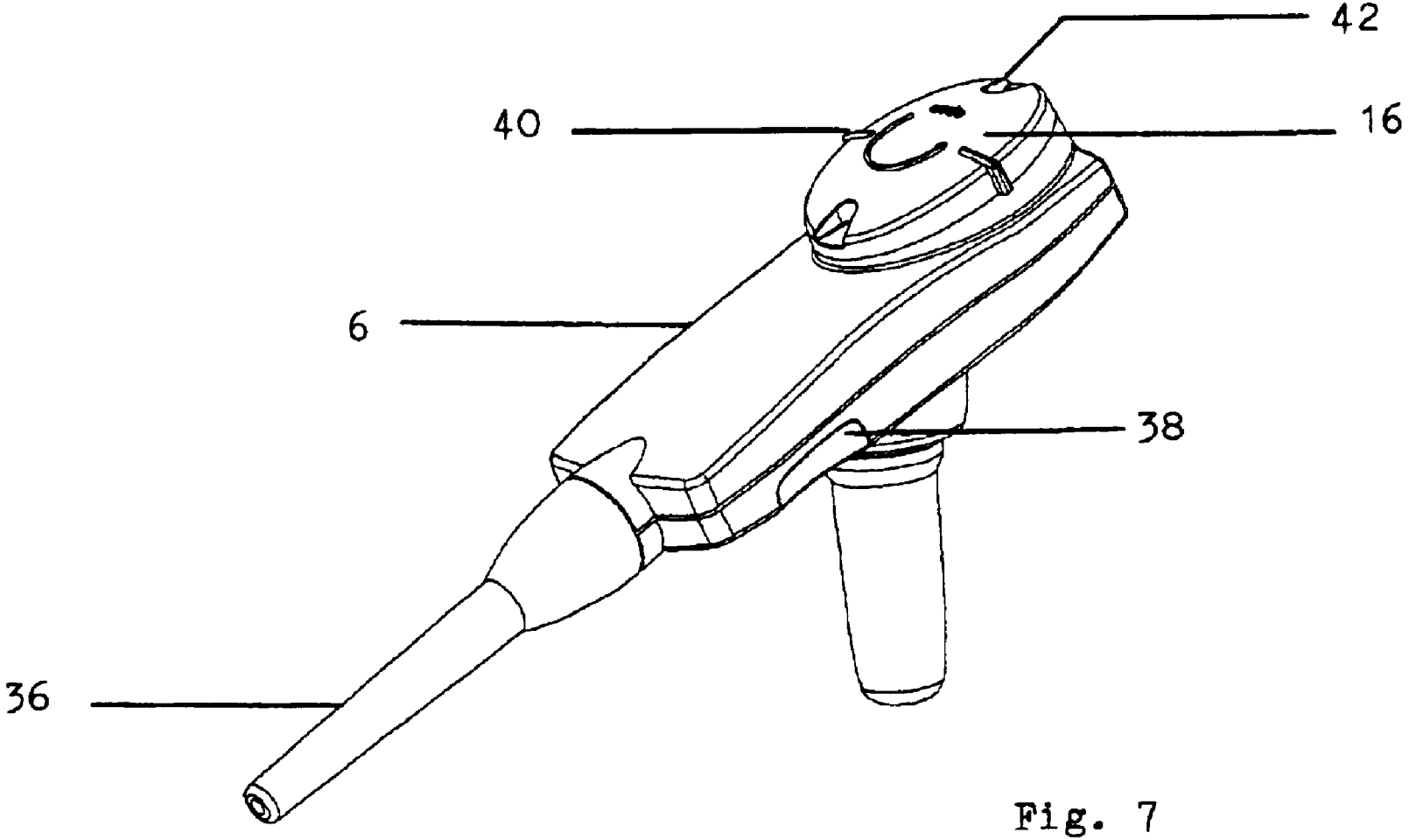
FIG. 7 is a perspective view of a fourth embodiment of the invention.

FIG. 7 is a perspective view of a fourth embodiment of the invention. In this embodiment, the headset case 6 of device 2 may have grips 38 allowing easier manipulation by the user.

This embodiment may also have cap 16 provided with knurl 40 which aids the user in removing/replacing cap 16 when replacing battery 14 (not visible in FIG. 7). This embodiment may also have cap 16 provided with indentation 42 which aid in retention of battery 14 inside of headset body 6. A battery cap having knurls allows easier removal and replacement of the battery cap, thereby allowing easier removal and replacement of the battery.

EXAMPLE 1

A wireless headset in accordance with the present invention was constructed having a sheath according to the preferred embodiment of the invention. The headset contained a circuit board having integrated chipsets and support components offering transmission and reception of radio waves. An ancillary base unit allowed the headset to cooperate with a telephone or similar device to provide hands free operation. By means of the present invention, the device has no ear clip, no head band and no retainer other than the sheath of the present invention, and thus the wireless headset is substantially miniaturized over products presently on the market. The sheath was narrower at the proximal end (inserted into the ear canal) than at the distal end. The end of the sheath is chamfered for further comfort and ease of use, with an aperture allowing passage of sound from the body of the wireless device to the ear canal of the user.

The body portions of the wireless device are a hard plastic material, but may be constructed of metal or other relatively hard materials.

The sheath is composed of a compliant silicon based compound or polymer.

In use, the sound tube, sheath disposed thereon, is inserted into one ear of the user. A microphone at the lower end of the device picks up the user's voice for transmission to a base unit connected to a cell phone, ordinary phone or equivalent device. A receiver in turn picks up transmissions from the base unit and converts them to audio using a mini-speaker located at the base of the sound tube. Sound from the mini-speaker travels from the sound tube, through the sound tube aperture and sheath aperture and thus to the ear canal of the user.

Should another user desire to use the device, the user may remove it from their ear canal, remove the polymer sheath, and hand it to the other user, who may then use their own polymer sheath to put it on. Polymer sheaths of different sizes than that listed above may be provided for different individuals.

The disclosure is provided to allow practice of the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

What is claimed is:

1. A wireless headset device adapted for positioning in a wearer's ear canal, comprising:

a. a body having a first surface and housing a speaker therein;

b. an elongated sound tube having a first predetermined length the majority of which is adapted for insertion into the wearer's ear and a predetermined cross-sectional dimension that is smaller than said first predetermined length, said sound tube extending outwardly from said first surface and along a first longitudinal axis; and c. an elongated sheath having a second predetermined length that is about the same as the first predetermined length, said sheath being releasably attached to said sound tube and extending co-linearly therewith, said sheath having a predetermined exterior dimension sufficient for frictionally engaging the canal of the wearer's ear, whereby said frictional engagement securely retains said sheath in said ear canal and the headset device in proximity to the wearer's ear.

2. The wireless headset device of claim 1, wherein the sheath is composed of a compliant polymer material.

3. The wireless headset device of claim 1, wherein the sheath is one member of the group consisting of: silicon based materials, silicon compounds, elastomeric materials, flexible materials, rubbers, gums, gels, soft silicon-like materials, liquids, liquids encased in a compliant shell, and combinations thereof.

4. The wireless headset device of claim 1, wherein the sheath is one member of the group consisting of:

mixtures of multiple compounds, mixtures of multiple polymers, polyphase foams, open cell foams, closed cell foams, material intrusions, material cells, liquids, and combinations thereof.

5. The wireless headset device of claim 1 wherein said sheath, further comprises: an open end;

and a circumferential ridge of material extending in proximity to said open end.

6. The wireless headset device of claim 1, wherein frictional forces exist between said sheath and the ear canal when said sheath is positioned in the ear canal.

7. The retainer of claim 3, wherein said body further comprises: a circumferential groove formed therein adjacent to said the sound tube, and wherein said circumferential ridge of material about the open end of the sheath mechanically cooperates with said circumferential groove to retain the sheath upon the sound tube.

8. A wireless headset device adapted for positioning in a wearer's ear canal, comprising:

a. a body having a first surface and housing a speaker therein;

b. an elongated, essentially hollow sound tube having a proximal end attached to said first surface and an open distal end, a first predetermined length and a predetermined cross-sectional dimension that is smaller than said first predetermined length, said sound tube extending along a first longitudinal axis that obliquely intersects said body;

c. an elongated, pliable sheath having opposing open ends concentrically positioned relative to said open distal end of said sound tube, said sheath being removably attached to said sound tube and extending co-linearly therewith, said sheath having a predetermined exterior dimension sufficient for frictionally engaging the canal of the wearer's ear, whereby said frictional engagement securely retains said sheath in said ear canal and the headset device in proximity to the wearer's ear.

9. The wireless headset device of claim 8, further comprising: an antenna extending outwardly from said body.

10. The wireless headset device of claim 9, further comprising one member selected from the group consisting of: a transceiver, a microphone, a receiver, an antenna, a battery and combinations thereof.

11. The wireless headset device of claim 9, wherein said antenna further comprises a microphone tube.

* * * * *

UNITED STATES PATENT AND TRADEMARK OFFICE

CERTIFICATE OF CORRECTION

PATENT NO. : 6,922,476 B2
DATED : July 26, 2005
INVENTOR(S) : Nassimi, Shary

It is certified that error appears in the above-identified patent and that said Letters Patent is hereby corrected as shown below:

Column 10,
Line 16, delete “the” between “said” and “sound”.

Signed and Sealed this

Twentieth Day of September, 2005

JON W. DUDAS
*Director of the United States Patent and Trademark Office*